US008885445B2

(12) United States Patent
Aoki

(10) Patent No.: US 8,885,445 B2
(45) Date of Patent: Nov. 11, 2014

(54) ELECTRONIC TIMEPIECE

(75) Inventor: Nobuhiro Aoki, Kokubunji (JP)

(73) Assignee: Casio Computer Co., Ltd, Tokyo (JP)

( * ) Notice: Subject to any disclaimer, the term of this patent is extended or adjusted under 35 U.S.C. 154(b) by 351 days.

(21) Appl. No.: 13/362,016

(22) Filed: Jan. 31, 2012

(65) Prior Publication Data

US 2012/0195172 A1 Aug. 2, 2012

(30) Foreign Application Priority Data

Jan. 31, 2011 (JP) ..... 2011-017413

(51) Int. Cl.
*G04C 3/00* (2006.01)
*G04C 10/02* (2006.01)
*G04C 10/04* (2006.01)

(52) U.S. Cl.
CPC ..... *G04C 10/02* (2013.01); *G04C 10/04* (2013.01)
USPC ..... 368/204; 368/76

(58) Field of Classification Search
USPC ..... 368/204, 66, 205, 64, 76; 320/101
See application file for complete search history.

(56) References Cited

U.S. PATENT DOCUMENTS 6,061,304 A * 5/2000 Nagata et al. ..... 368/66
6,816,439 B1 11/2004 Kawahara et al.
7,933,168 B2 * 4/2011 Kawaguchi ..... 368/66
8,111,590 B2 * 2/2012 Asami et al. ..... 368/204
2002/0183865 A1 * 12/2002 Ichikawa et al. ..... 700/15
2003/0231553 A1 * 12/2003 Kibiloski et al. ..... 368/67
2008/0225647 A1 9/2008 Kawaguchi
2008/0225648 A1 9/2008 Kawaguchi
2013/0194896 A1 * 8/2013 Kato et al. ..... 368/66

FOREIGN PATENT DOCUMENTS

EP 1026559 8/2000
EP 1113349 7/2001
JP 2002-153972 6/2002
JP 2008-224544 9/2008
JP 2008-224545 9/2008

OTHER PUBLICATIONS

Japanese Office Action for Japanese Application No. 2011-017413 mailed on Oct. 16, 2012.
Extended European Search Report for European Application No. 12153300.4 mailed Sep. 6, 2012.

* cited by examiner

*Primary Examiner* — Sean Kayes
(74) *Attorney, Agent, or Firm* — Amin, Turocy & Watson, LLP

(57) ABSTRACT

An electronic timepiece includes: a power generation unit that generates power by taking in energy from outside; a battery that stores the generated power; a generated power monitor that intermittently and repeatedly measures the power generated by the power generation unit; an input amount analyzing section that performs an analysis on an energy input amount based on the measurement results of the generated power monitor; and a power generation urging notification controller that starts power generation urging notification if it is determined, based on the analysis result of the input amount analyzing section, that the energy input amount is low on average.

6 Claims, 10 Drawing Sheets

FIG.4

| CURRENT RANGE | AD CONVERSION VALUE | ILLUMINANCE (lx) | POINTS |
|---|---|---|---|
| 10 μA RANGE | 0 | ⋮ | -2 |
| | 1 | ⋮ | -2 |
| | 2 | ⋮ | -2 |
| | 3 | ⋮ | -2 |
| | 4 | ⋮ | -2 |
| | 5 | 250 | +1 |
| | 6 | ⋮ | +1 |
| | 7 | ⋮ | +1 |
| | 8 | 500 | +4 |
| | 9 | ⋮ | +4 |
| | 10 | 640 | +4 |
| 100 μA RANGE | 1 | 880 | +8 |
| | 2 | ⋮ | +8 |
| | 3 | 2,500 | +20 |
| | 4 | ⋮ | +20 |
| | 5 | ⋮ | +20 |
| | 6 | 5,000 | +40 |
| | 7 | ⋮ | +40 |
| | 8 | ⋮ | +40 |
| | 9 | ⋮ | +40 |
| | 10 | 8,000 | +52 |
| 1 mA RANGE | 1 | 10,000 | +64 |
| | 2 | 20,000 | +96 |
| | 3 | ⋮ | +168 |
| | 4 | 50,000 | +240 |
| | 5 | ⋮ | +240 |
| | 6 | 100,000 | +480 |
| | 7 | ⋮ | +480 |
| | 8 | ⋮ | +480 |
| | 9 | ⋮ | +480 |
| | 10 | ⋮ | +480 |

ELECTRONIC TIMEPIECE

CROSS REFERENCE TO RELATED APPLICATION(S)

The present disclosure relates to the subject matters contained in Japanese Patent Application No. 2011-017413 filed on Jan. 31, 2011, which are incorporated herein by reference in its entirety.

FIELD

One or more embodiments of the present invention relate to an electronic timepiece which operates on electric energy that is generated therein and stored in its battery.

BACKGROUND OF THE INVENTION

Electronic timepieces are known which is equipped with a solar panel and a secondary battery and operates on electric energy that is generated by the solar panel and stored in the secondary battery. Among such electronic timepieces are ones which make a display for notifying a user of a state that the voltage of the secondary battery has become so low that the secondary battery needs to be charged.

Techniques relating to the present invention are disclosed in prior art references JP-A-224544 (corresponding to US 2008/0225647 A1) and JP-A-2008-224545 (corresponding to US 2008/0225648 A1). That is, they disclose techniques for displaying an amount of generated power in real time or displaying an accumulated electric energy generated or a duration of a timepiece operation in an electronic timepiece in which power is generated by self-winding and manual winding.

In secondary batteries, the battery voltage and the stored electric energy do not have a proportional relationship. At a stage that the stored electric energy is small, a reduction in battery capacity can be detected from a battery voltage because the battery voltage decreases at a relatively high rate as the secondary battery is used. However, at a stage that the battery capacity is in a medium range, it is difficult to estimate a battery capacity from a battery voltage because the battery voltage is kept almost constant.

The procedure that a reduction in battery capacity is detected from a battery voltage and a user is informed that the secondary battery needs to be charged is associated with the following problems. Since the battery capacity has already become so low that a transition to a sleep mode in which various functions of the timepiece are suspended may be made if a non-power-generation state continues for a certain period of time. If such an event occurs, it takes a long time to charge the secondary battery fully. That is, it is preferable that the user be informed a little earlier that the secondary battery needs to be charged, because this allows the user to cause, with a sufficient margin, a transition to an environment that enables power generation.

Measurement of generated power necessitates power consumption because, for example, it is necessary to cause a generated current to flow through a detection resistor. Since a generated current is not very large, it is difficult to use a detection resistor having so small a resistance that its power consumption is negligible. Therefore, even in the case where generated power is measured in such a manner that a user is notified with proper timing that the secondary battery needs to be charged, the energy consumption is large as long as the generated power is measured all the time.

SUMMARY OF THE INVENTION

One or more embodiments of the present invention provide an electronic timepiece which can urge, with proper timing, a user to start power generation without causing a large energy consumption.

One aspect of the present invention provides an electronic timepiece including a power generation unit that generates power by taking in energy from outside; a battery that stores the generated power; a generated power monitor that intermittently and repeatedly measures the power generated by the power generation unit; an input amount analyzing section that performs an analysis on an energy input amount based on the measurement results of the generated power monitor; and a power generation urging notification controller that starts power generation urging notification if it is determined, based on the analysis result of the input amount analyzing section, that the energy input amount is low on average.

BRIEF DESCRIPTION OF THE DRAWINGS

FIG. 4 is a data chart showing a relationship between the measurement value of generated power, the illuminance, and the points;

DETAILED DESCRIPTION OF THE EMBODIMENTS

Embodiments of the present invention will be hereinafter described with referent to the drawings.

[First Embodiment]

Figure 1:
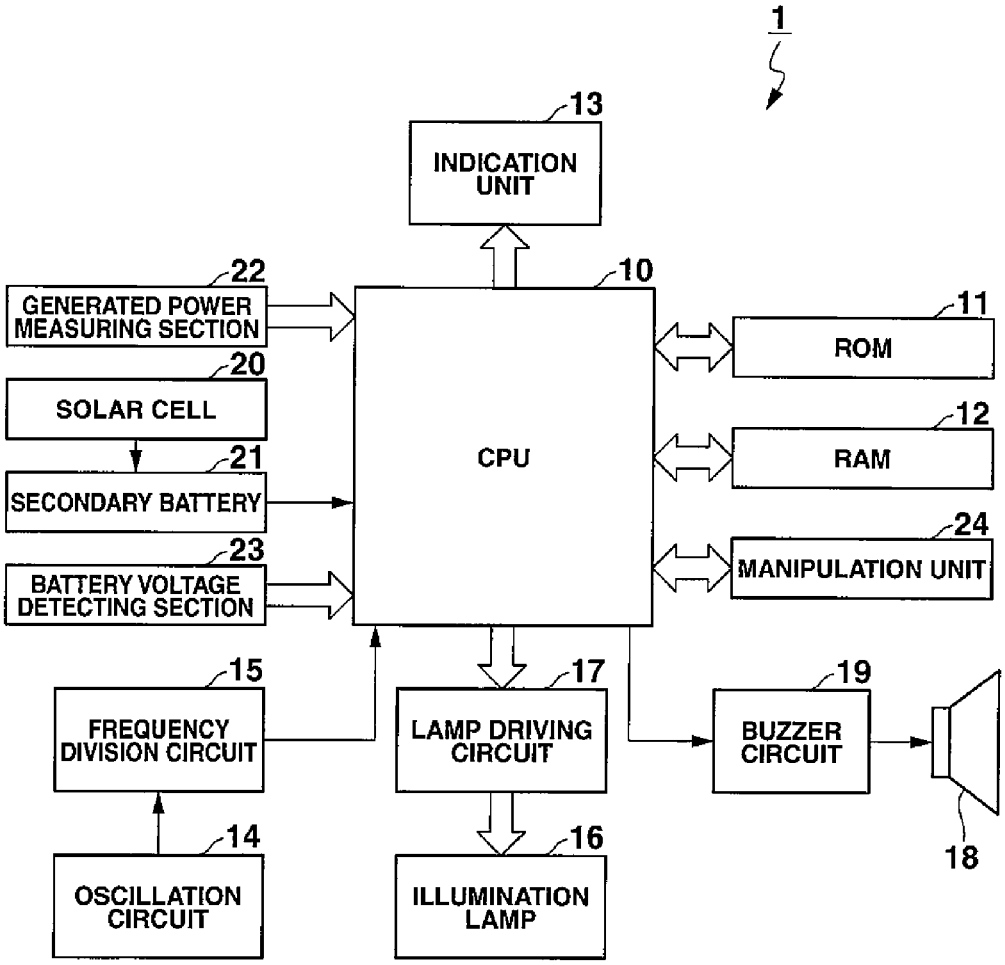
FIG. 1 is a block diagram showing the entire configuration of an electronic timepiece according to a first embodiment of the present invention.

FIG. 1 is a block diagram showing the entire configuration of an electronic timepiece according to a first embodiment of the invention.

The electronic timepiece 1 is, for example, a wrist watch having a solar power generating function of generating power using incident light. The electronic timepiece 1 is equipped with a central processing unit (CPU) 10 for overall controlling of individual circuits etc., a read only memory (ROM) 11 for storing control programs to be performed by the CPU 10 and control data, a random access memory (RAM) 12 for providing a work memory space for the CPU 10, an indication unit 13 for indicating such information as time by driving the hands with a stepping motor, an oscillation circuit 14 and a frequency division circuit 15 for supplying a signal indicating a prescribed frequency to the CPU 10, an illumination lamp 16 and a lamp driving circuit 17 for illuminating the indication unit 13, a speaker 18 and a buzzer circuit 19 for outputting an alarm sound, a solar cell 20 as a power generation unit and an optical power generation unit which is exposed in the dial and generates power by receiving incident light coming from outside, a secondary battery 21 for storing generated power and supplying power to the individual circuits via the CPU 10, a generated power measuring section 22 for measuring generated power of the solar cell 20, a battery voltage detecting section 23 for detecting a battery voltage of the secondary battery 21, a manipulation unit 24 to be manipulated by the user, etc.

Figure 2:
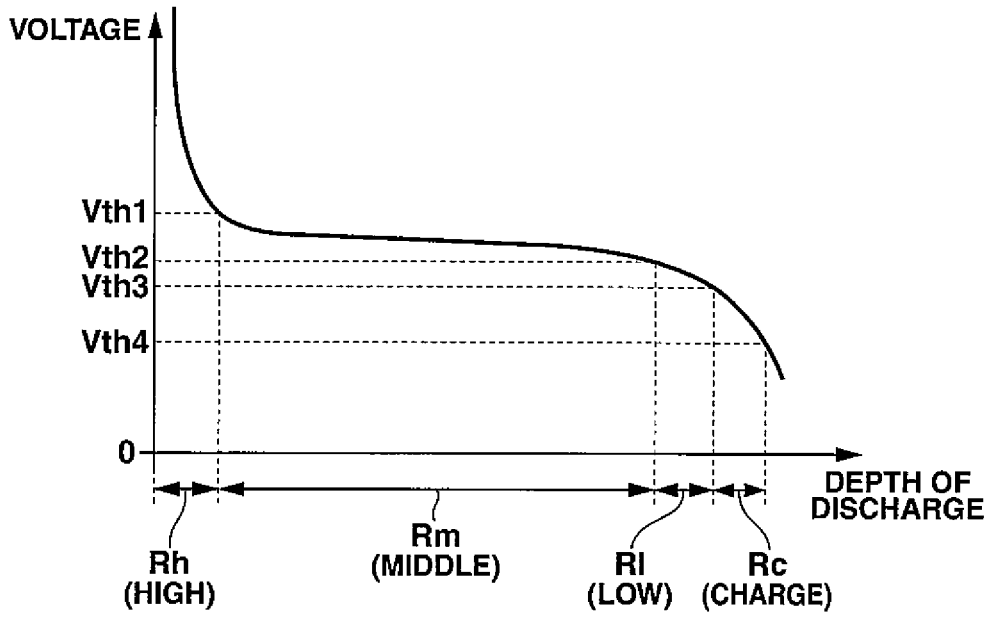
FIG. 2 is a graph showing a relationship between the voltage and the depth of discharge of a secondary battery.

FIG. 2 is a graph showing a relationship between the voltage and the depth of discharge of the secondary battery 21.

As shown in FIG. 2, the voltage of the secondary battery 21 is high in a high range Rh where it is charged almost fully, and is low in a low range Rl where it has been discharged to a large extent and is stored with only a very small amount of electricity and a charge range Rc where charging is necessary. On the other hand, the voltage variation is gentle in a middle range Rm which is an ordinary use range where the depth of discharge is in a medium range. The battery voltage varies relatively greatly in the narrow ranges Rh, Rl and Rc where the depth of discharge is very small or large, and hence the ranges Rh, Rl and Rc can be recognized from comparison between battery voltage and threshold values Vth1 to Vth4. On the other hand, since, in the wide middle range Rm which is the ordinary use range, the battery voltage varies to only a small extent, it is difficult to recognize a depth of discharge from a battery voltage.

The battery voltage detecting section 23 detects a battery voltage of the solar cell 20, and determines which of the four ranges Rh, Rm, Rl, and Rc the depth of discharge of the secondary battery 21 is in by comparing the detected battery voltage with the above-mentioned threshold values Vth1 to Vth4.

Figure 3:
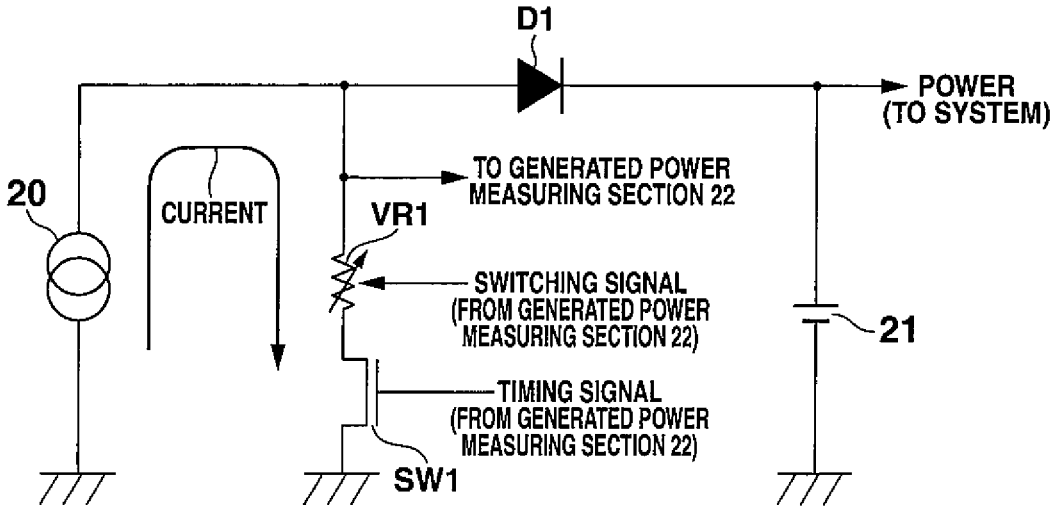
FIG. 3 shows the configuration of a circuit for measuring generated power of a solar cell.

FIG. 3 shows the configuration of a circuit for measuring generated power of the solar cell 20.

The generated power measuring section 22 measures a generated current of the solar cell 20 intermittently (e.g., every 10 minutes) and supplies measurement data to the CPU 10. As shown in FIG. 3, in an ordinary state, a generated current of the solar cell 20 flows to the secondary battery 21 via a reverse-blocking diode D1. A circuit having a variable resistor VR1 for converting a generated current into a voltage and a switch SW1 for guiding a generated current to the variable resistor VR1 is connected to the solar cell 20. At measurement timing, the generated power measuring section 22 outputs a timing signal to the switch SW1 and thereby causes a generated current to flow through the variable resistor VR1. Furthermore, the generated power measuring section 22 receives conversion voltages of the variable resistor VR1 while switching the resistance of the variable resistor VR1, and AD (analog-to-digital)-converts the received voltages and thereby generates measurement data representing amounts of generated power.

FIG. 4 is a data chart showing a relationship between the measurement value of generated power, the illuminance, and the points.

As seen from a current range column and an AD conversion value column of FIG. 4, the generated power measuring section 22 can measure the generated current in a wide range including, for example, a 10 μA range, a 100 μA range, and a 1 mA range by performing measurements while switching between resistance values corresponding to the three respective current ranges. A generated current is represented by a switching stage of the variable resistor VR1 and an AD conversion value.

The ROM 11 is stored with a program for a timepiece control process for indicating time by driving the hands as time elapses, outputting an alarm at a preset time, causing illumination in response to a user manipulation, and setting an alarm time, a program for a charging management process for managing the charging state of the secondary battery 21 and providing the user with charging urging notification with proper timing, and other programs.

The ROM 11 is also stored with the data table shown in FIG. 4 as control data to be used in the charging management process. Actually, the ROM 11 is stored with the data of the item "AD conversion value" of each of the three current ranges and the item "points" among the items of the data chart shown in FIG. 4.

The AD conversion values of each current range correspond to respective illuminance values of light incident on the solar cell 20, and their corresponding relationship is determined by acquiring AD conversion values while illuminating the actual electronic timepiece 1 at various illuminance values. In the example of FIG. 4, if an AD conversion value "5" is obtained in a state that the resistance corresponding to the 10 μA range is selected, it can be determined that the illuminance of incident light is 250 lx.

The points shown in FIG. 4 area parameter to be used in the charging management process, and are determined on the basis of a time length that allows generation of electric energy that is equal to an average energy consumption of one day with incident light having corresponding illuminance. For example, assume that time lengths Y that allow generation of the electric energy that is equal to the average energy consumption of one day with incident light having respective illuminance values X are as follows:

| Illuminance X | Time length Y |
|---|---|
| 50,000 lx | 8 minutes |
| 10,000 lx | 30 minutes |
| 5,000 lx | 48 minutes |
| 500 lx | 8 hours |

First, points corresponding to the typical illuminance 500 lx are determined so that total points of one day become "±0" when the electric energy that is equal to the average energy consumption of one day is generated at this illuminance. As a reference value of points, points corresponding to darkness in which no power can be generated are set at "−2" so that points can be represented by an integer having a small number of bits. It is also assumed that illuminance is measured every 10 minutes and resulting points are added together.

With the above assumptions, points that are obtained by 8 hours of light incidence at illuminance 500 lx (8 (hours)×6 (the number of measurements per hour)×Z (points)) plus points that are obtained by 16 (=24−8) in darkness with no power generation (16 (hours)×6 (the number of measurements per hour)×(−2) (points)) should be equal to 0. Therefore, it is determined that the points Z of the illuminance 500 lx should be "4."

Next, points Z of the other illuminance values X are determined on the basis of the points "4" of the typical illuminance 500 lx. The points Z of each of the other illuminance values X are determined so that the ratio of the time length Y that allows generation of the energy consumption of one day at the illuminance X concerned to that at the illuminance 500 lx is equal to the reciprocal of the ratio of the points Z of the illuminance X concerned to those of the illuminance 500 lx. For example, in the case of the illuminance 5,000 lx, since its time length 48 minutes is 1/10 of the time length 8 hours corresponding to the illuminance 500 lx, its points Z are calculated to be "40" (=4×10). According to this method of determination, points Z corresponding to each of the following illuminance values X are determined as follows:

| Illuminance X | Time length Y | Points Z |
|---|---|---|
| 50,000 lx | 8 minutes | +240 |
| 10,000 lx | 30 minutes | +64 |
| 5,000 lx | 48 minutes | +40 |
| 500 lx | 8 hours | +4 |
| 0 lx | — | −2 |

The points shown in FIG. 4 as corresponding to the respective illumination values are points determined by the above method. When a time length Y is unknown that allows generation of the energy consumption of one day at illuminance that is halfway between two illuminance values X whose points Z have been determined in the above-described manner, corresponding points Z may be determined so that the points vary smoothly instead of being determined on the basis of the time length Y. For example, the points of each of illuminance values that are smaller than 500 lx (i.e., 250 lx to 450 lx) are given a point "+1."

Instead of being determined strictly according to the above equation for determination, points may have a certain error. For example, if integer points are not obtained according to the above equation for determination, a calculated value may be rounded into an integer.

In the above method of determination, the points corresponding to only the typical illuminance 500 lx are determined so that total points of one day become "±0" when the electric energy that is equal to the average energy consumption of one day is generated in 8 hours at this illuminance and no power generation is performed in the other period because of darkness. Alternatively, points corresponding to every illuminance value may be determined in this manner.

[Charging Management Process]

Next, the charging management process for providing the user with charging urging notification with proper timing using generated current values measured intermittently by the generated power measuring section 22 and points that are stored as corresponding to each of the generated current values measured.

Figure 5:
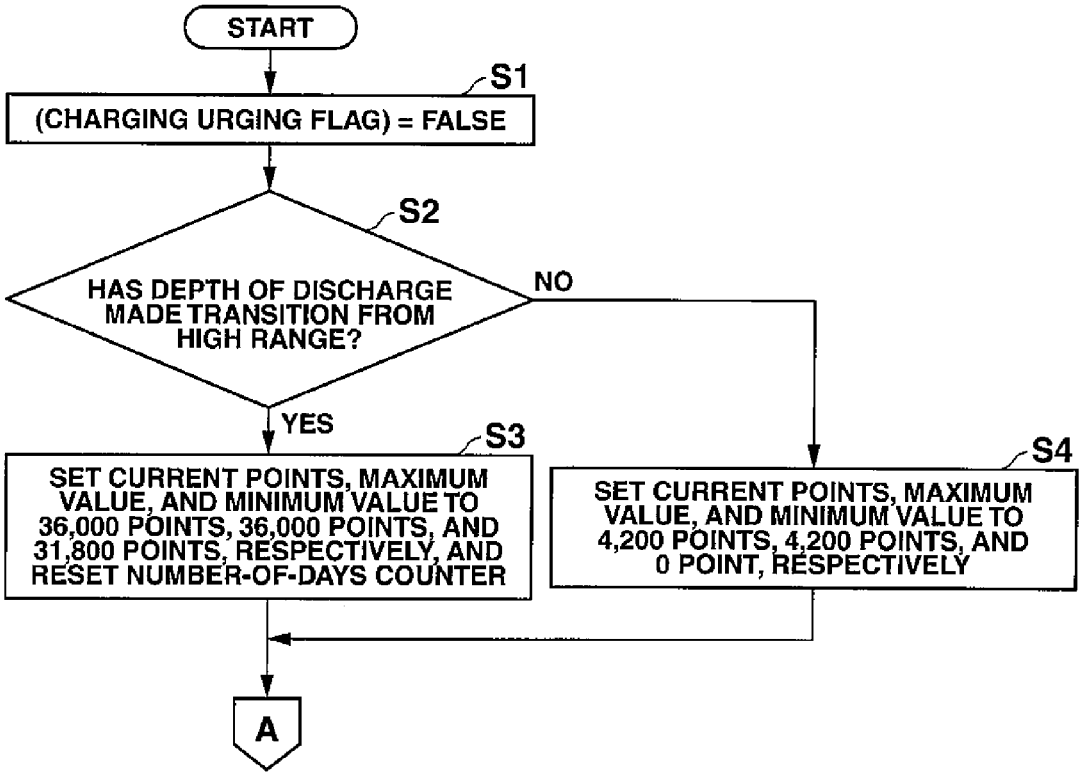
FIGS. 5 and 6 are flowcharts of a charging management process according to the first embodiment which is performed by a CPU.
Figure 6:
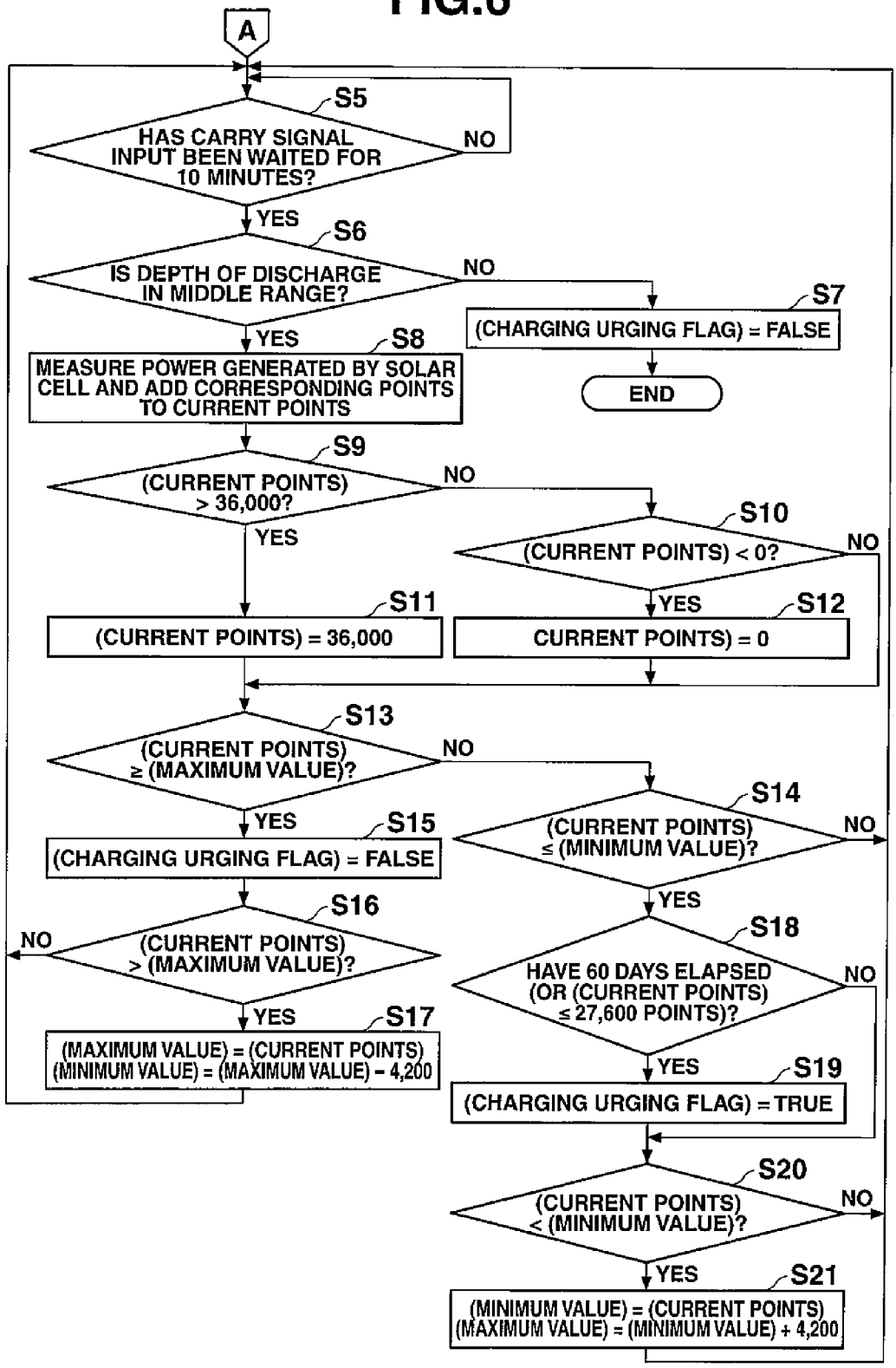
Figure 7:
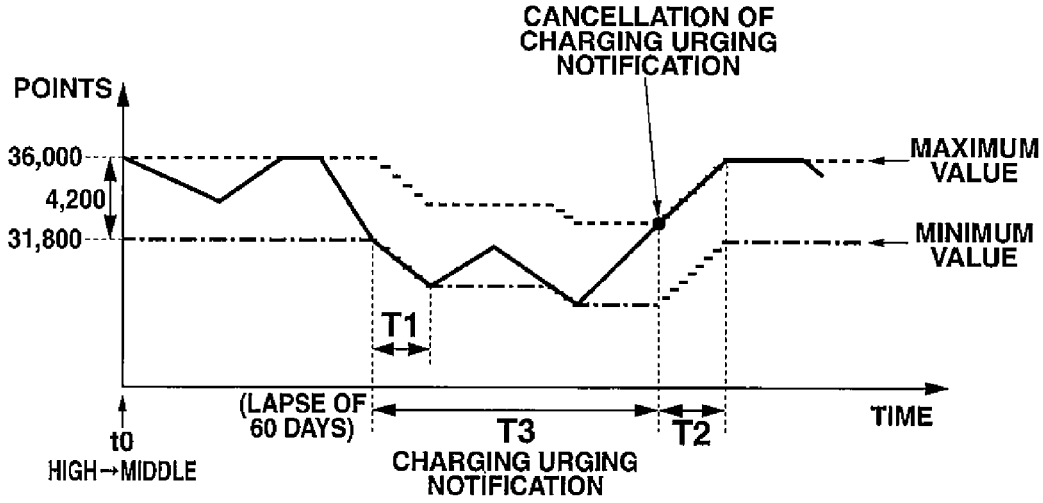
FIGS. 7 and 8 are graphs showing first and second example operations, respectively, realized by the charging management process and showing how the total points etc. are varied.
Figure 8:
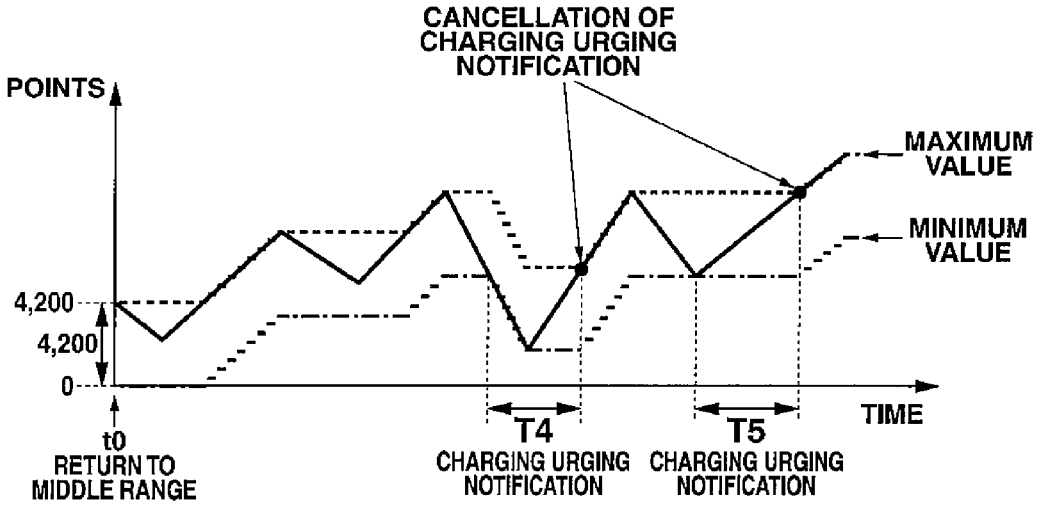

FIGS. 5 and 6 are flowcharts of the charging management process which is performed by the CPU 10. FIGS. 7 and 8 are graphs showing first examples of variation and second examples of variation, respectively, of the total points (called current points; represented by a solid line) which are calculated in the charging management process and a minimum value (chain line) and a maximum value (broken line) which are threshold values for a start and a cancellation, respectively, of charging urging notification.

The charging management process is started when it is determined, on the basis of a battery voltage of the secondary battery 21 detected by the battery voltage detecting section 23, that the depth of discharge of the secondary battery 21 has made a transition to the middle range Rm, and gives the user with charging urging notification with such proper timing that the degree of charging has become low but the depth of discharge has not become too large in the middle range Rm.

In the charging management process, as shown in FIGS. 7 and 8, the minimum value for a start of charging urging notification and the maximum value for a cancellation of charging urging notification are set. Charging urging notification is made when the total points (current points) of points corresponding to results of intermittent measurements (performed every 10 minutes, for example) of the generated power measuring section 22 have become smaller than or equal to the minimum value. The charging urging notification is cancelled thereafter when the current points have become larger than or equal to the maximum value. The minimum value, the maximum value, and the current points are stored in prescribed areas (a small threshold value memory, a large threshold value memory) of the RAM 12.

In the charging management process, the minimum value and the maximum value for a start and a cancellation, respectively, of charging urging notification are not fixed. If the current points have become smaller than the minimum value, as in a period T1 shown in FIG. 7 the minimum value is updated to a smaller value and the maximum value is also updated to a smaller value so that the difference between the maximum value and the minimum value is kept at a constant value (e.g., 4,200 points).

On the other hand, if the current points have become larger than the maximum value, as in a period T2 shown in FIG. 7 the maximum value is updated to a larger value and the minimum value is also updated to a larger value so that the difference between the maximum value and the minimum value is kept at the constant value (e.g., 4,200 points).

In the charging management process, the initial values of the current points, the minimum value, and the maximum value at a start of the charging management process are set differently in the following manners depending on whether the depth of discharge has entered the middle range Rm from the high range Rh or the low range Rl.

First, a description will be made of a case that the depth of discharge has entered the middle range Rm from the high range Rh. In this case, the maximum value, the minimum value, and the current points are set to initial values of 36,000 points, 31,800 points, and 36,000 points, respectively, as shown in FIG. 7 at timing t0. The maximum value is set to 36,000 points which has a certain margin so that the current points have a small positive value when power has not been generated for a long time and the depth of discharge of the secondary battery 21 has been increased and made a transition to the low range Rl.

The difference between the maximum value and the minimum value is set to 4,200 points so that the current points vary in a proper time length to issuance of a charging urging notice in, for example, a case that power has not been generated for about two weeks.

In the first embodiment, during a prescribed number of days (e.g., 60 days) immediately after a transition from the high range Rh to the middle range Rm, the depth of discharge of the secondary battery 21 does not vary at a high rate and hence it is not necessary to start charging urging notification. Therefore, during such a prescribed number of days, charging urging notification is not provided as an exceptional way even if the current points become smaller than the minimum value. Furthermore, an exceptional condition of not providing charging urging notification even if the current points have become smaller than the minimum value may also be provided in a situation that it is determined that the depth of discharge has not become very large as in a case that the current points are large (e.g., 27,600 or more).

Next, initial settings that are made when a transition is made from the low range Rl to the middle range Rm will be described. In this case, the maximum value, the minimum value, and the current points are set to initial values of 4,200 points, 0 point, and 4,200 points, respectively, as shown in FIG. 8 at timing t0. These initial values are employed so that the probability that the current points have a large negative value is low when the depth of discharge is in the middle range Rm.

After initial settings of either kind are made, as shown in FIG. 7 or 8 the current points vary as power is generated and discharges occur. As mentioned above, the current points are a total value of points corresponding to generated currents measured intermittently. Charging urging notification is started (periods T3, T4, and T5) when the current points have become smaller than or equal to the minimum value, and is cancelled thereafter when the current points have become larger than or equal to the maximum value.

The charging management process is finished if it determined, on the basis of a voltage of the secondary battery 21 detected by the battery voltage detecting section 23, that the depth of discharge has made a transition to the high range Rh or the low range Rl.

The flowcharts shown in FIGS. 5 and 6 realize the above-described operations. When the charging management process is started as a result of a transition to the middle range Rm, first, at step S1, the CPU 10 initializes a charging urging flag to "false." If the charging urging flag is changed to "true," the timepiece control process for driving the hands is switched from an ordinary operation in which the second hand is moved by one step every one second to a notification operation in which the second hand is moved by two steps every two seconds. The notification operation allows the user to recognize that he or she is urged to charge the electronic timepiece 1.

At step S2, the CPU 10 determines whether the depth of discharge has made a transition to the middle range Rm from the high range Rh or the low range Rl. Initialization of step S3 is performed if the transition has been made from the high range Rh, and initialization of step S4 is performed if the transition has been made from the low range Rl. The variables are set to the above-mentioned initial values, respectively. In the initialization of step S3, a number-of-days counter is reset to perform a control (exceptional measure) of not providing charging urging notification during a prescribed number of days (e.g., 60 days) after the transition from the high range Rh to the middle range Rm.

Then, the CPU 10 moves to a processing loop (steps S5-S21) of performing controls of updating the current points while measuring a charging current sequentially in a prescribed cycle (e.g., 10 minutes) and providing charging urging notification while varying the minimum value and the maximum value according to various conditions.

First, after waiting for input of a carry signal from the frequency division circuit 15 for 10 minutes at step S5, at step S6 the CPU 10 determines, on the basis of a voltage detected by the battery voltage detecting section 23, whether or not the depth of discharge is in the middle range Rm. If the depth of discharge is not in the middle range Rm, the CPU 10 makes the charging urging flag "false" at step S7 and finishes the charging management process.

On the other hand, if the depth of discharge is in the middle range Rm, at step S8 the CPU 10 causes the generated power measuring section 22 to measure a generated current, reads points corresponding to the measured generated current from the data table stored in the ROM 11, and adds the read-out points to the current points. The standby processing of step S5 and the measurement/control processing of step S8 constitute a generated power monitor. And processing of converting a measurement result to points (conversion-into-points section) and processing of calculating total points (computing section) constitute an input amount analyzing section for performing an analysis on an energy input amount.

At steps S9 and S10, the CPU 10 determines whether or not the current points are out of the range between the maximum value 36,000 and the minimum value 0. If the current points are within the range, the CPU 10 moves to step S13 without performing any processing. If the current points are out of the range, the CPU 10 corrects the current points to the maximum value 36,000 (step S11) or the minimum value 0 to be within the range (step S12).

At steps S13 and S14, the CPU 10 determines whether the current points have become larger than or equal to the maximum value or smaller than or equal to the minimum value. If both judgment results are negative (i.e., the current points are between the minimum value and the maximum value), the CPU 10 returns to step S5 without performing any processing.

On the other hand, if the current points have become larger than or equal to the maximum value, at step S15 the CPU 10 makes the charging urging flag "false." As a result, if charging urging notification has been provided, it is canceled. At step S16, the CPU 10 determines whether or not the current points are larger than the maximum value. If the current points are not larger than (i.e., are equal to) the maximum value, the CPU 10 returns to step S5 without performing any processing. If the current points are larger than the maximum value, at step S17 the CPU 10 updates the maximum value to the current points and updates the minimum value to the maximum value minus 4,200 points (second settings changing section). Then, the CPU 10 returns to step S5.

If it is determined at step S14 that the current points are smaller than or equal to the minimum value, at step S18 the CPU 10 determines whether the condition for the exceptional measure of not providing charging urging notification is satisfied or not. More specifically, the CPU 10 determines whether or not the prescribed number of days (60 days) have elapsed since the depth of discharge made a transition from the high range Rh to the middle range Rm. The exceptional measure may also be taken if it is determined that the current points are smaller than or equal to 27,600 points which are large points. If the condition for the exceptional measure of not providing charging urging notification is not satisfied, at step S19 the CPU 10 changes the charging urging flag to "true" (power generation urging notification controller). As a result, the above-mentioned charging urging operation of moving the second hand every two seconds is started. Then, the CPU 10 moves to step S20. On the other hand, if the condition for the exceptional measure of not providing charging urging notification is satisfied, the CPU 10 moves to step S20 without updating the charging urging flag.

At step S20, the CPU 10 determines whether or not the current points are smaller than the minimum value. If the current points are not smaller than (i.e., are equal to) the minimum value, the CPU 10 returns to step S5 without performing any processing. If the current points are smaller than the minimum value, at step S21 the CPU 10 updates the minimum value to the current points and updates the maximum value to the minimum value plus 4,200 points (first settings changing section). Then, the CPU 10 returns to step S5.

The charging management operations of FIGS. 7 and 8 which were described previously are realized by the above control procedure.

As described above, in the electronic timepiece 1 according to the first embodiment, generated power is measured intermittently by the generated power measuring section 22 and the illuminance of incident light is analyzed (converted into points) on the basis of a measurement result.

If it is determined that the average incident light intensity is low, charging urging notification is provided. Therefore, the user can be provided with charging urging notification with proper timing, for example, at a stage that the depth of discharge has increased by more than a half or ⅔, for example, of the width of the middle range Rm (such timing cannot be detected merely by detecting a battery voltage of the secondary battery 21). This allows the user to establish an environment in which power can be generated in the electronic timepiece 1 with a sufficient time margin (i.e., with no need to hurry), whereby a proper charging state can be maintained without suspending the timepiece functions. Furthermore, since generated power is measured intermittently, generated power can be measured relatively correctly with a small power consumption.

In the electronic timepiece 1 according to the first embodiment, a measurement result of generated power is converted into points that are set so as to correspond to illuminance of incident light. And the user is provided with charging urging notification when the current points which are a total value of points that are obtained sequentially have become smaller than or equal to the minimum value. Therefore, a situation that the average incident light intensity is low can be recognized in a simple manner with a small load.

In the electronic timepiece 1 according to the first embodiment, points Z that correspond to illuminance X of incident light are set on the basis of the illuminance X and a time length Y that allows generation of electric energy that is equal to an average energy consumption of one day with incident light having the illuminance X so that the total points of one day become close to ±0 if the generated energy is equal to the average energy consumption of one day, that the total points of one day increases if the generated energy is larger than the average energy consumption of one day, and that the total points of one day decreases if the generated energy is smaller than the average energy consumption of one day. Therefore, even if time elapses as a state with power generation and a state without power generation occur repeatedly with the depth of discharge kept in the middle range Rm, the relationship between the total points and the depth of discharge does not deviate soon.

On the other hand, in the electronic timepiece 1 according to the first embodiment, total generated energy cannot be recognized correctly because generated current is not measured all the time. Furthermore, the points that are set so as to correspond to each illuminance value of incident light have an error with respect to the condition that the total points should become ±0 if the generated energy is equal to the average energy consumption of one day. Therefore, the total points and the actual depth of discharge of the secondary battery 21 do not have a correct one-to-one relationship. In view of this, in the electronic timepiece 1 according to the first embodiment, when the total points go out of the range bounded by the minimum value and the maximum value for a start and a cancellation, respectively, of charging urging notification, the minimum value and the maximum value are shifted to the same direction as the deviation direction of the total points. This makes it possible to start and cancel charging urging notification with proper timing even if the relationship between the total points and the actual depth of discharge deviates from a correct one.

The minimum value and the maximum value are shifted by an amount by which the total points have become smaller than the minimum value or larger than the maximum value. Therefore, in starting charging urging notification because the generated power has become small on average or canceling charging urging notification because the generated power has, become large on average, start or cancellation timing of the charging, urging notification can be determined properly.

In the electronic timepiece 1 according to the first embodiment, since the solar cell 20 which generates power using incident light is employed as a power generation unit, average generated power can be estimated relatively correctly by intermittent generated power measurements. Furthermore, an operation of moving the second hand every two seconds is employed as charging urging notification, the charging urging notification which the user is apt to realize can be provided with a small power consumption.

[Second Embodiment]

Figure 9:
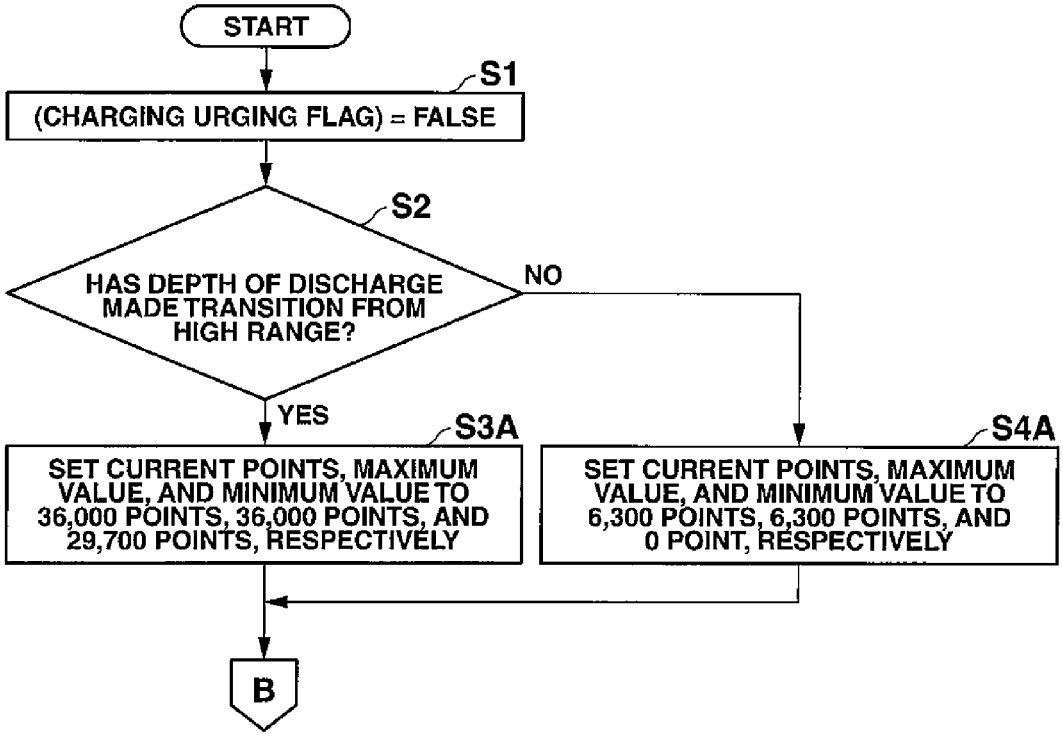
FIGS. 9 and 10 are flowcharts of a charging management process according to a second embodiment which is performed by a CPU.
Figure 10:
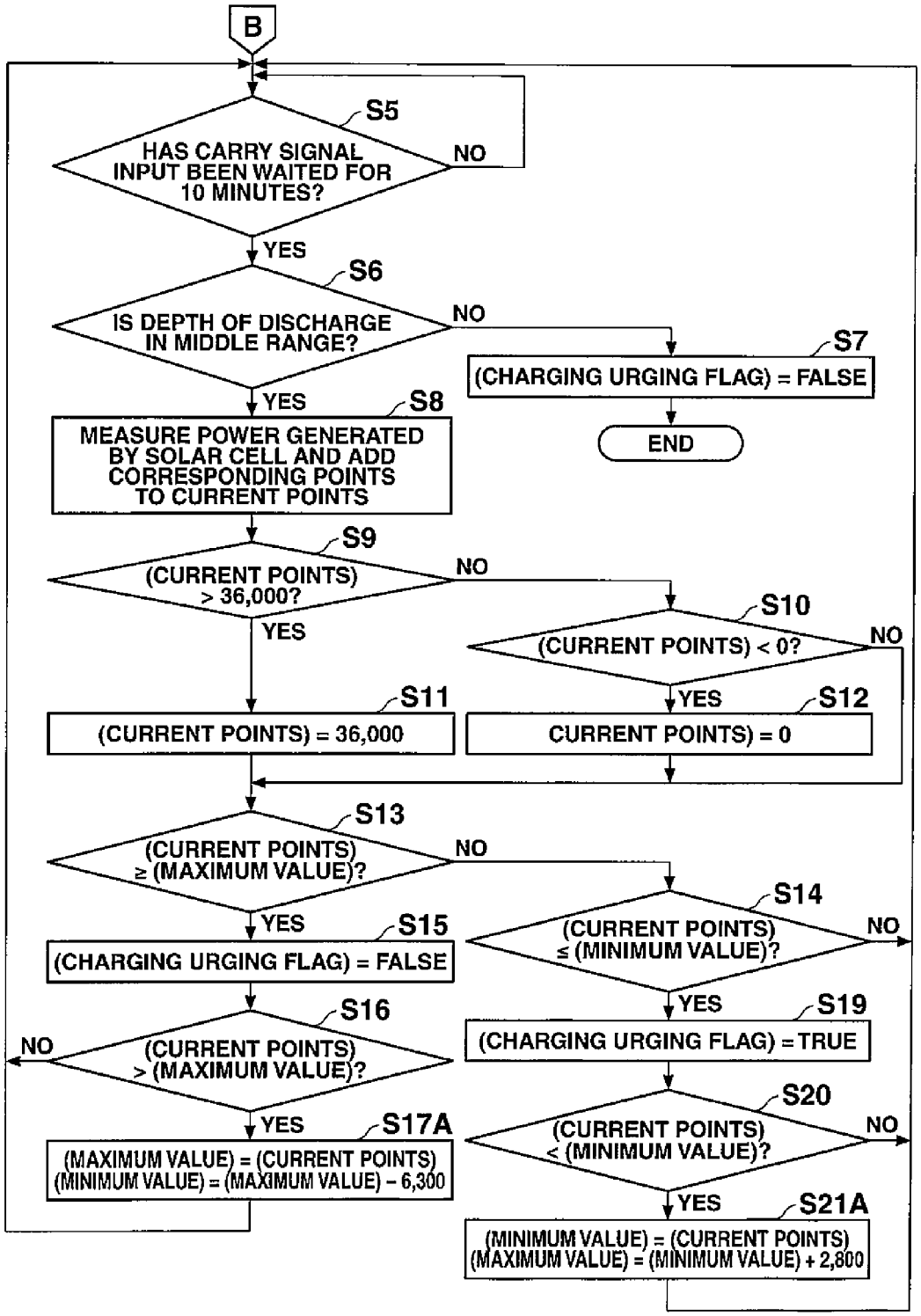
Figure 11:
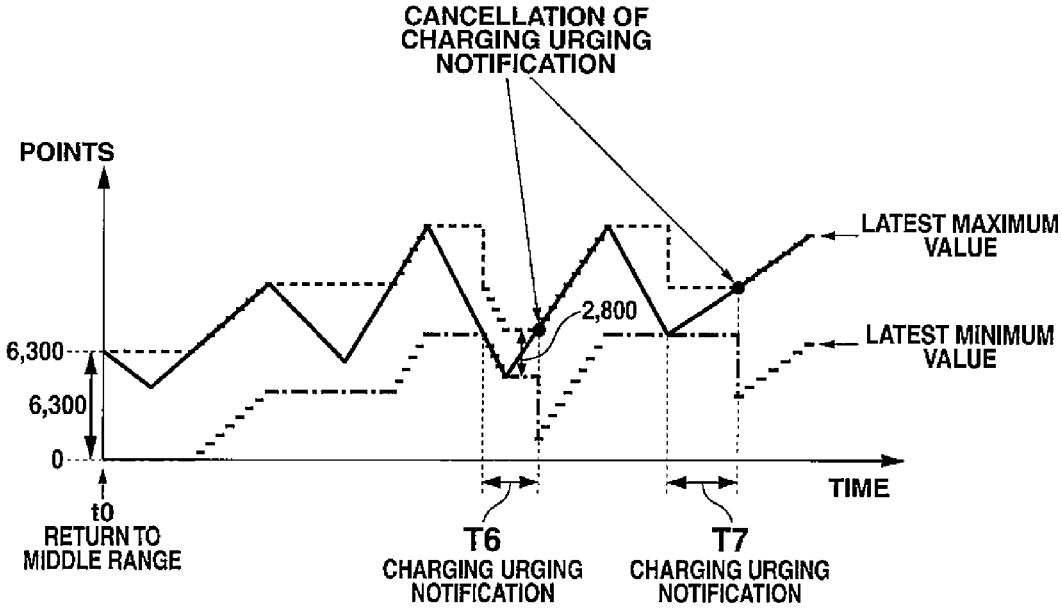
FIG. 11 is a graph showing an example operation realized by the charging management process according to the second embodiment and showing how the total points etc. are varied.

FIGS. 9 and 10 are flowcharts of a charging management process which is performed by the CPU 10. FIG. 11 is a graph showing examples of variation of the current points (represented by a solid line), the minimum value (chain line), and the maximum value (broken line) occurring in the charging management process according to the second embodiment.

An electronic timepiece according to the second embodiment is mainly different from the electronic timepiece 1 according to the first embodiment in that the difference between the minimum value and the maximum value which are threshold values for determination of a start and a cancellation, respectively, of charging urging notification is varied between two stages. The other features of the second embodiment are the approximately the same as the corresponding features of the first embodiment and will not be described in detail.

As shown in FIG. 11, in the second embodiment, the difference between the minimum value and the maximum value is varied between two stages, that is, 6,300 points and 2,800 points. The difference is decreased to 2,800 points when the current points have become smaller than the minimum value, and is increased to 6,300 points when the current points have become larger than the maximum value while charging urging notification is provided. In initial setting which is performed when the depth of discharge of the secondary battery 21 has made a transition to the middle range Rm, the difference between the minimum value and the maximum value is set to 6,300 points.

With the above settings, as shown in FIG. 11, the difference between the minimum value and the maximum value is as large as 6,300 points in a period when no charging urging notification is provided. As a result, the time length that is taken until a start of charging urging notification from establishment of a state that the generated current is small on average is made longer than in the first embodiment. In charging urging notification periods T6 and T7, the charging urging notification is canceled earlier than in the first embodiment when a state that the generated current is large on average is established after the charging urging notification was started because the current points became smaller than the minimum value.

FIGS. 9 and 10 are flowcharts of a charging management process which realizes the above operation. This charging management process is different from the charging management process according to the first embodiment in steps S3A and S4A for setting initial values for the respective variables and steps S17A and S21A for changing the minimum value and the maximum value, and the same as the charging management process according to the first embodiment in the other steps.

If the charging management process is started and it is determined at step S2 that the depth of discharge has entered the middle range Rm from the high range Rh, the CPU 10 moves to step S3A, where the CPU 10 initializes the current points, the maximum value, and the minimum value to 36,000 points, 36,000 points, and 29,700 points, respectively. If it is determined at step S2 that the depth of discharge has entered the middle range Rm from the low range Rl, the CPU 10 moves to step S4A, where the CPU 10 initializes the current points, the maximum value, and the minimum value to 6,300 points, 6,300 points, and 0 point, respectively.

If it is determined that the current points are smaller than the minimum value (S20: yes), at step S21A the CPU 10 updates the minimum value to the current points and updates the maximum value to the minimum value plus 2,800 points (first settings changing section, first difference).

If it is determined that the current points are larger than the maximum value (S26: yes), at step S17A the CPU 10 updates the maximum value to the current points and updates the minimum value to the maximum value minus 6,300 points (second settings changing section, second difference).

In the charging management process according to the second embodiment, the step (step S18 in FIG. 6) for abstaining from providing the user with charging urging notification as an exceptional measure is omitted because a long time is taken until a start of charging urging notification.

The charging management operation that was described above with reference to FIG. 11 is realized by the above control procedure.

In the electronic timepiece 1 according to the second embodiment, the difference between the minimum value and the maximum value is changed to the different values when the current points have become smaller than the minimum value and when the current points have become larger than the maximum value. Therefore, the time length that is taken until a start charging urging notification from establishment of a state the generated power is low on average and the time length that is taken until a cancellation of charging urging notification from establishment of a state the generated power is high on average can be adjusted as appropriate.

[Third Embodiment]

Figure 12:
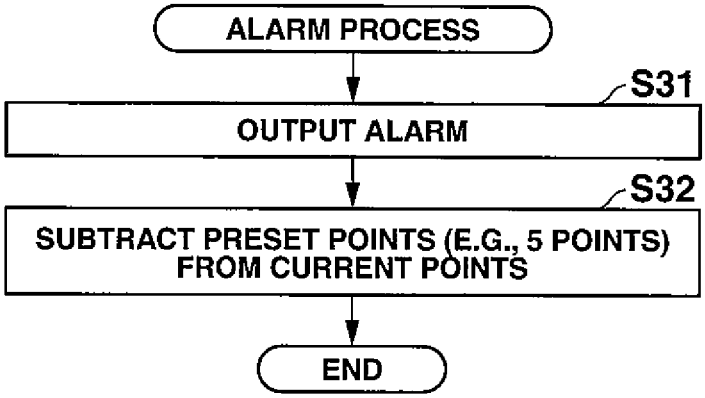
FIG. 12 is a flowchart of an alarm process according to a third embodiment which is performed by a CPU.
Figure 13:
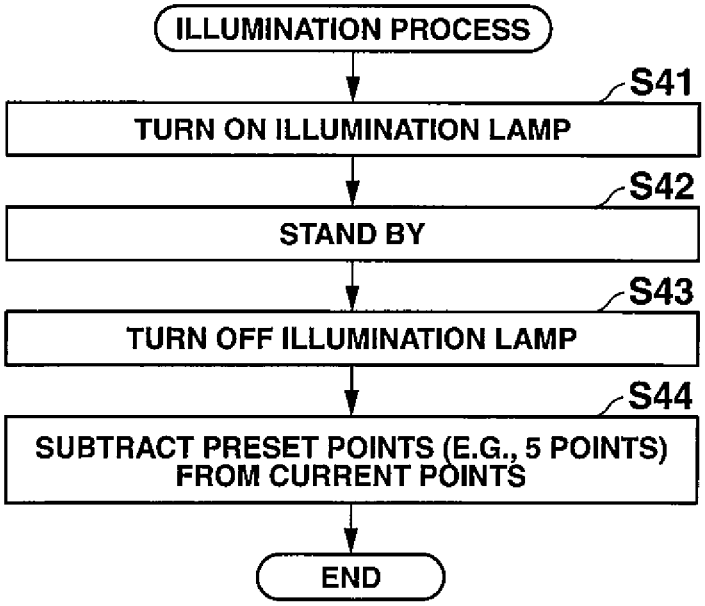
FIG. 13 is a flowchart of an illumination process according to the third embodiment which is performed by the CPU.

FIGS. 12 and 13 are flowcharts of an alarm process and an illumination process according to a third embodiment, respectively, which are performed by the CPU 10.

In the electronic timepiece 1 according to the third embodiment, when an alarm has been generated or the illumination lamp 16 has been driven based on a user manipulation, a setting, or the like as an unordinary operation which is not included in ordinary timepiece operations, points corresponding to an energy consumption of the driving are subtracted from the current points calculated in the charging management process. The charging management process and the other features are the same as in the first embodiment.

If the alarm process of FIG. 12 is started because of arrival of a setting time, at step S31 the CPU 10 supplies an instruction to the buzzer circuit 19 to cause the speaker 18 to output an alarm. At step S32, the CPU 10 subtracts points (e.g., 5 points) that are preset as corresponding to an energy consumption of the output of an alarm from the current points calculated in the charging management process (points subtracting section). Then, the alarm process is finished.

If the illumination process of FIG. 13 is started in response to a user manipulation, at step S41 the CPU 41 turns on the illumination lamp 16 by supplying an instruction to the lamp driving circuit 17. After standing by for a prescribed time at step S42, at step S43 the CPU turns off the illumination lamp 16 by supplying an instruction to the lamp driving circuit 17. At step S44, the CPU 10 subtracts points (e.g., 5 points) that are preset as corresponding to an energy consumption of the lamp driving from the current points calculated in the charging management process (points subtracting section). Then, the illumination process is finished.

In the electronic timepiece 1 according to the third embodiment, when an operation that is not fixed in operation timing or frequency and is not included in ordinary timepiece operations has been performed, points corresponding to an energy consumption of the operation are subtracted from the current points calculated in the charging management process. This enables charging management in which an energy consumption of such an unordinary operation is taken into consideration.

The invention is not limited to the above embodiments and various modifications are possible. For example, although in the above embodiments the solar cell 20 is used as an example power generation unit, the invention is likewise applicable to electronic timepieces using power generation units of such a type that power generation in a small range can be continued for a relatively long time, such as a heat power generation unit which generates power by absorbing heat when the timepiece is attached to a human hand and a self-winding power generation unit which generates power by taking in kinetic energy when the timepiece itself is moved. On, the other hand, it is difficult to apply the invention to electronic timepieces using power generation units of such a type that high power is generated instantaneously, such as a manual winding power generation unit.

Although in the above embodiments generated power is measured periodically, the cycle of intermittent measurements need not always be fixed and may have a small variation as long as approximately average generated power can be measured. Charging urging notification may be provided in the form of a digital display, vibration, or a sound. Other details that are described in the embodiments in a specific manner, such as the circuit configuration for detecting a generated current, the method for setting points corresponding to each illumination value of incident light, and the method for setting threshold values for a start and a cancellation of charging urging notification, can be modified as appropriate without departing from the spirit and scope of the invention.

What is claimed is:

1. An electronic timepiece comprising:

a power generation unit that generates power by taking in energy from outside;

a battery that stores the generated power;

a generated power monitor that intermittently and repeatedly measures the power generated by the power generation unit; and an input amount analyzing section that performs an analysis on an energy input amount based on the measurement results of the generated power monitor;

wherein the input amount analyzing section comprises:

a conversion-into-points section that converts each measurement result of the generated power monitor into points, each of the points representing magnitude of an energy input amount; and a computing section that sequentially adds together points generated by the conversion-into-points section; and wherein the electronic timepiece further comprises:

a minimum value memory that stores a minimum value which is a value for a start of charging urging notification when total points obtained by the computing section are smaller than the minimum value;

a maximum value memory that stores a maximum value which is a value for a cancellation of the charging urging notification when the total points are larger than the maximum value after the start of the charging urging notification; and a charging urging notification controller that starts charging urging notification when the total points are smaller than the minimum value, wherein the charging urging notification controller comprises:

a first settings changing section that decreases the minimum value and the maximum value by a difference between the total points and the minimum value while maintaining a difference between the minimum value and the maximum value, when the total points are smaller than the minimum value; and a second settings changing section that increases the minimum value and the maximum value by a difference between the total points and the maximum value while maintaining a difference between the minimum value and the maximum value, when the total points are larger than the maximum value.

2. The electronic timepiece according to claim 1, wherein:

the first settings changing section sets the difference between the minimum value and the maximum value at a first value from a time point when the total points fall short of the minimum value to a time point when the total points exceed the maximum value;

the second settings changing section sets the difference between minimum value and the maximum value at a second value from a time point when the total points exceed the maximum value to a time point when the total points fall short of the minimum value; and the second value is different from the first value.

3. The electronic timepiece according to claim 2, wherein:

the power generation unit is an optical power generation unit which generates power by absorbing incident light; and the power generation urging notification controller causes, as the power generation urging notification, an indication operation that a second hand is moved two steps every two seconds.

4. The electronic timepiece according to claim 1, further comprising a points subtracting section that subtracts points corresponding to a prescribed power-consuming operation from the total points obtained by the computing section when the prescribed power-consuming operation is performed.

5. The electronic timepiece according to claim 2, further comprising a points subtracting section that subtracts points corresponding to a prescribed power-consuming operation from the total points obtained by the computing section when the prescribed power-consuming operation is performed.

6. The electronic timepiece according to claim 1, wherein:

the power generation unit is an optical power generation unit which generates power by absorbing incident light; and the charging urging notification controller causes, as the charging urging notification, an indication operation that a second hand is moved two steps every two seconds.

* * * * *